US009802781B2

(12) United States Patent
Kugimiya et al.

(10) Patent No.: US 9,802,781 B2
(45) Date of Patent: Oct. 31, 2017

(54) TAPE DISPENSER

(71) Applicant: 3M INNOVATIVE PROPERTIES COMPANY, St. Paul, MN (US)

(72) Inventors: Michitomo Kugimiya, Kanagawa (JP); Philipp H. Refior, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/353,078

(22) PCT Filed: Oct. 11, 2012

(86) PCT No.: PCT/US2012/059803
§ 371 (c)(1),
(2) Date: Apr. 21, 2014

(87) PCT Pub. No.: WO2013/059072
PCT Pub. Date: Apr. 25, 2013

(65) Prior Publication Data

US 2014/0284367 A1 Sep. 25, 2014

(30) Foreign Application Priority Data

Oct. 21, 2011 (JP) ..... 2011-231710

(51) Int. Cl.
*B65H 35/06* (2006.01)
*B65H 35/00* (2006.01)

(52) U.S. Cl.
CPC ..... *B65H 35/06* (2013.01); *B65H 35/0026* (2013.01); *Y10T 225/246* (2015.04)

(58) Field of Classification Search
CPC ..... B65H 35/06; B65H 35/0026
USPC ..... 225/25, 39, 43, 46, 47, 6–10, 16; 242/324, 556.1, 570, 599.3, 588, 588.3, 242/588.6, 405
See application file for complete search history.

(56) References Cited

U.S. PATENT DOCUMENTS 2,678,777 A * 5/1954 Donkin ..... B65H 35/0026 225/19
3,102,671 A * 9/1963 Gershen ..... B65C 11/00 225/43
4,447,281 A * 5/1984 Joy ..... 156/250
(Continued)

FOREIGN PATENT DOCUMENTS

JP H01-76850 5/1989
JP H02-124968 10/1990
JP H03-12852 2/1991
(Continued)

OTHER PUBLICATIONS

International Search Report for PCT International Application No. PCT/US2012/059803, dated Mar. 19, 2013, 3pgs.

*Primary Examiner* — Jonathan Riley
*Assistant Examiner* — Liang Dong
(74) *Attorney, Agent, or Firm* — Robert H. Jordan

(57) ABSTRACT

The present disclosure provides improved tape dispensers that include a case featuring a pair of opposing main plates each coupled to two circumferential wall plates. The main plates, and corresponding circumferential wall plates, are rotatable relative to one another to expose a support structure for a tape roll. A cutting blade may be provided on one of the circumferential wall plates and may include a substantially arc shaped support surface.

2 Claims, 8 Drawing Sheets

(56) References Cited

U.S. PATENT DOCUMENTS

| | | | | |
|---|---|---|---|---|
| 2002/0056526 | A1* | 5/2002 | Kelders ..... | B65H 35/0033<br>156/577 |
| 2009/0230163 | A1 | 9/2009 | Chang | |

FOREIGN PATENT DOCUMENTS

| | | | |
|---|---|---|---|
| JP | 08-310714 | | 11/1996 |
| JP | 10-044088 | | 2/1998 |
| JP | 10-120282 | | 5/1998 |
| JP | 10-157911 | | 6/1998 |
| JP | 10157911 | A * | 6/1998 |
| JP | 2004-277040 | | 10/2004 |
| JP | 2006-232461 | | 9/2006 |
| JP | 3129973 | | 3/2007 |
| JP | 2007-137601 | | 6/2007 |

* cited by examiner

TAPE DISPENSER

BACKGROUND

Multiple type shapes of the tape dispenser used for roll shaped adhesive tape are known according to the previous technology and especially, relative to the compact type tape dispenser that is durable and can be repeatedly used. Exemplary dispensers include those described in JP175850 and JP2124968.

Previous dispensers incorporate a structure that is formed from a case, which houses the tape roll, and a cutter, which is attached on the tape wind/unwind opening provided on one part of the circumferential wall of this case, so that it can be opened and closed. The cutter becomes unified as one part with the circumferential wall of the case, and the dispenser becomes one that has a compact shape in the state when it is not being used.

SUMMARY

The above described tape dispenser according to the previous technology is a dispenser that has desirable compactness properties.

In the case of the tape dispenser reported according to JP175850, however, there is no means for holding (preserving) the front edge of the adhesive tape and it is easy for the adhesive tape to roll and wind back on the tape roll. Once the adhesive tape has rolled back, because of the fact that the tape dispensing opening is narrow, recovering the front edge of the adhesive tape to dispense becomes difficult. In that case, it is necessary that the tape roll be removed from the case. Also, in the case of the tape dispenser reported in the JP175850, it is easy for dust to adhere onto the tape roll as one surface of the case is left open.

On the other hand, in the case of the tape dispenser reported in JP2124968, the front edge of the adhesive tape is held on the cutter through the adhesive agent of the adhesive tape itself. Also, the case has a structure that surrounds the whole body of the tape roll, reducing the ability of dust to adhere to the adhesive tape. However, if the front edge of the adhesive tape is separated from the cutter and the adhesive tape is back wound in such a construction, it is necessary that the case cover removed and the tape roll is taken out of the case. Also, exchanging a used tape roll for a new one similarly takes time and effort.

The present disclosure provides a tape dispenser, which while maintaining the compactness properties highlighted above, has improved operational properties.

In the case of an exemplary tape dispenser according to the present disclosure, the tape dispenser includes a case that houses the tape roll and is provided with the first and second main plates that are placed at a uniform distance. The two main plates are mutually connected so they can rotate relative to one another. A circumferential wall is provided in the gap between the first and the second main plates, and the circumferential wall, in its circumferential direction, is divided into the first and second circumferential wall parts, which are correspondingly formed as one body with the first and second main plates. A supporting rod 38, which is provided one of the main plates, supports the free rotation of the tape roll within the case. A cutter blade is provided on a circumferential wall part and is typically proximate a substantially arc shaped support surface. When the first main plate rotates relative to the second main plate, the tape roll is widely exposed and adhesive tape can be easily grasped and secured relative to the support surface.

In one aspect, the present disclosure provides a tape dispenser comprising a case operable to house a tape roll, the case including a first main plate, a second main plate spaced from the first main plate and rotatably connected to the first main plate, a circumferential wall between the first main plate and the second main plate, wherein the circumferential wall is divided along its circumferential direction into a first circumferential wall portion and second circumferential wall portion, wherein the first circumferential wall portion is integral with the first main plate, and the circumferential wall portion is integral with the second main plate, a supporting rod extending from one of the first or second main plate in the direction of the opposing main plate, and a cutter blade disposed on one of the first and second circumferential wall portions.

The terms "comprises" and variations thereof do not have a limiting meaning where these terms appear in the description and claims.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As recited herein, all numbers should be considered modified by the term "about".

As used herein, "a," "an," "the," "at least one," and "one or more" are used interchangeably. Thus, for example, a label remover comprising "a" microblade may be considered to include "one or more" microblades.

Also herein, the recitations of numerical ranges by endpoints include all numbers subsumed within that range (e.g., 1 to 5 includes 1, 1.5, 2, 2.75, 3, 3.80, 4, 5, etc.).

The above summary of the present invention is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exhaustive list.

DETAILED DESCRIPTION OF ILLUSTRATIVE EMBODIMENTS

Figure 1:
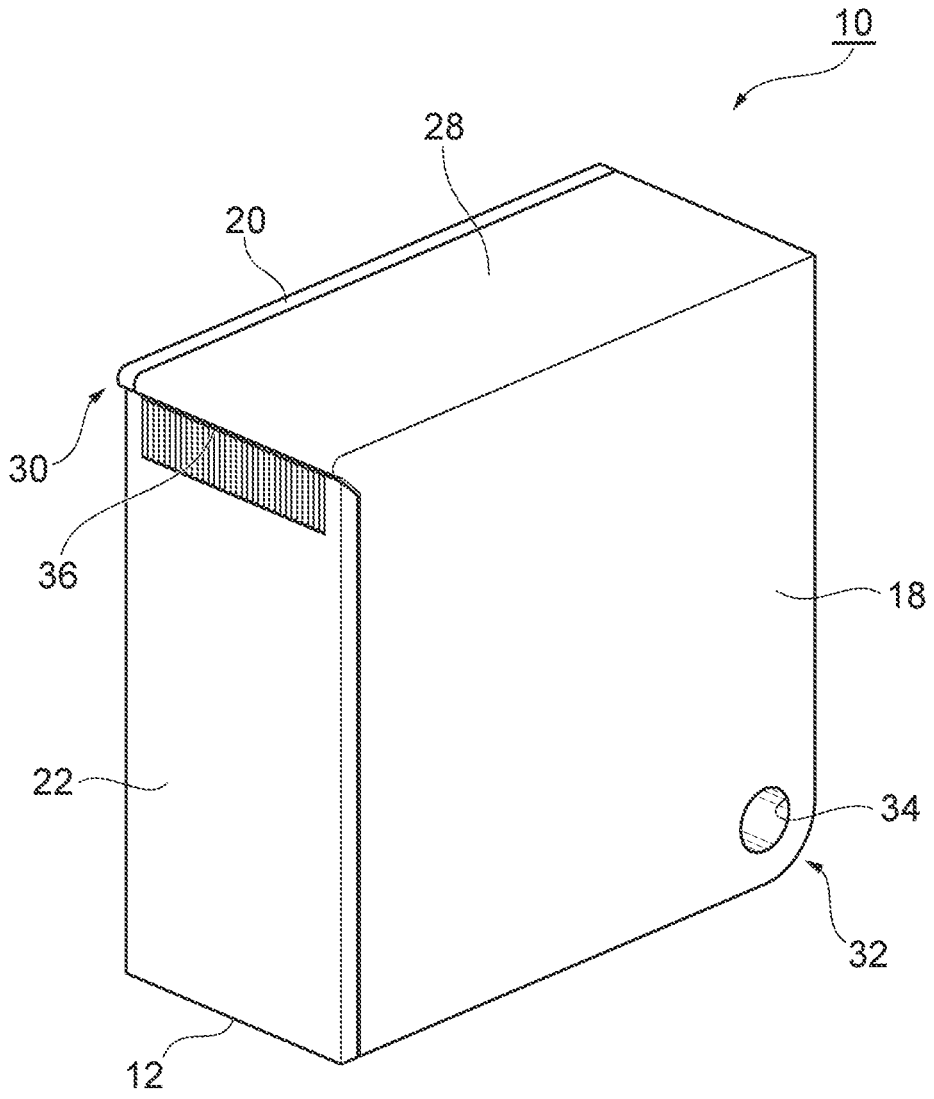
FIG. 1 is a three-dimensional view of one practical implementation of the tape dispenser according to the present invention and it is a diagram showing a closed state.

A tape dispenser according to a first embodiment of the present invention will be described. In the case of the tape dispenser according to this implementation, it is a dispenser where a case, which houses a tape roll whose structure is formed as an adhesive tape is wound in a roll shape, is provided, and the adhesive tape that is unwound from the tape roll can be cut by this dispenser. The case is characterized by the fact that it is equipped with the first main plate 1, the second main plate 2, which is placed at a certain gap from this main plate 1, a circumferential wall provided in the space between the main plate 1 and the main plate 2, and a supporting rod, which is used in order to support the tape roll so it can freely rotate and which is provided on either of the main plate 1 or the main plate 2 and extends facing the other main plate, and regarding the circumferential wall, which mutually connects the main plate 1 and the main plate 2, so they can move, it is divided along its circumferential direction into a circumferential wall part 1 and circumferential wall part 2, and the circumferential wall part 1 is formed as one body with the main plate 1, and the circumferential wall part 2 is formed as one body with the main plate 2, and on either one of the circumferential part 1 or the circumferential part 2 a cutter blade is provided.

In the case of the above described tape dispenser structure, rotating the main plate relative to the other main plate causes the separated circumferential wall portions to be opened together with the main plate rotation, which in turn at least partially exposes the cutter blade provided on one of the circumferential wall parts. Also, in this open state of the case, the circumferential surface of the tape roll becomes widely exposed and it becomes easy to view and grasp the circumferential surface of the tape roll. Also, through this rotation of the main plate relative to the other main plate, the supporting rod that is provided on one of the main plates also moves so that is located at a distance from the inner surface of the other main plate. In that case the exchange of the tape roll becomes easier due to the lack of an opposing plate.

A substantially arc-shaped tape supporting surface can be provided on the back surface side of the cutter blade. The adhesive tape can adhere to such a supporting surface and accordingly prevent the back winding of the adhesive tape toward the tape roll. The support surface further provides contact area to ease the tearing of tape across the cutter blade.

In certain implementations, it can be useful if the supporting rod is provided on the first main plate and the cutter blade is provided on the second circumferential wall part. In such an embodiment, rotation of the main plate relative to the other main plate causes the distance between the tape roll attached to the supporting rod and the cutter blade to substantially increase and making it easier to pull out a length of adhesive tape between the cutter blade and the tape roll.

It can be advantageous, in certain circumstances, if the free end of the supporting rod provided on either the first main plate or the second main plate is in contact with the opposing main plate, so that it engages (i.e., rubs against) the inner surface of the other main plate to provide additional support to the tape roll during opening, closing, and dispensing. This additional stability can allow for the case to be opened with one hand.

Also, one or more protrusions can be provided for the supporting rod. The protrusion can control the movement of the supporting rod beyond a certain point relative to the opposing main plate, allowing a user to maintain the case in an opened state while limiting the excessive rotation of the main plates.

In the case of such a tape dispenser, as it has been described here above, the circumferential surface of the tape roll can be easily accessed because the circumferential wall can be opened in the circumferential direction. Consequently, even if the adhesive tape is back wound on the tape roll, it is possible to easily grasp the front end of the adhesive tape and unwind it from the tape roll. Furthermore, through the relative rotational position of the first main plate and the second main plate, it is possible to eliminate the interference with the tape roll attached on the supporting rod, and it becomes easy to exchange the tape roll.

The tape dispensers of present disclosure provide compactness at the time of use while still allowing for recourse to unintentionally back wound adhesive tape and easier exchange of the tape roll. Furthermore, in the state where the case is closed, the tape roll is enclosed by the main plates and the circumferential wall and because of that also the tape roll is protected from dust, etc.

The diagrams will be used as reference and an explanation will be provided regarding exemplary implementations of the present disclosure. Moreover, in all of the diagrams, for the same parts the same symbols have been used and a repeated explanation will be omitted.

Figure 2:
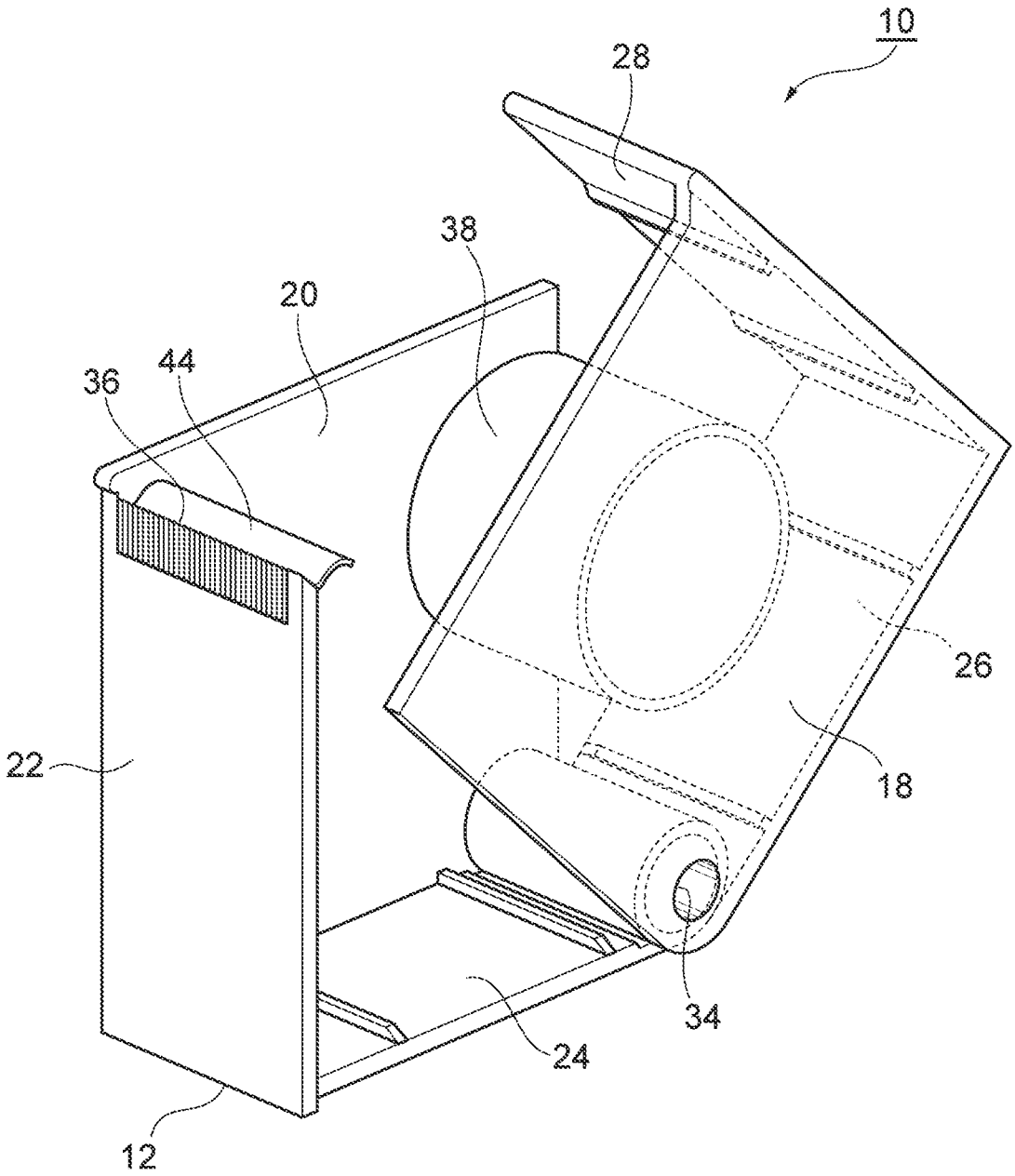
FIG. 2 is a three-dimensional view showing a closed state of the tape dispenser in FIG. 1.
Figure 3:
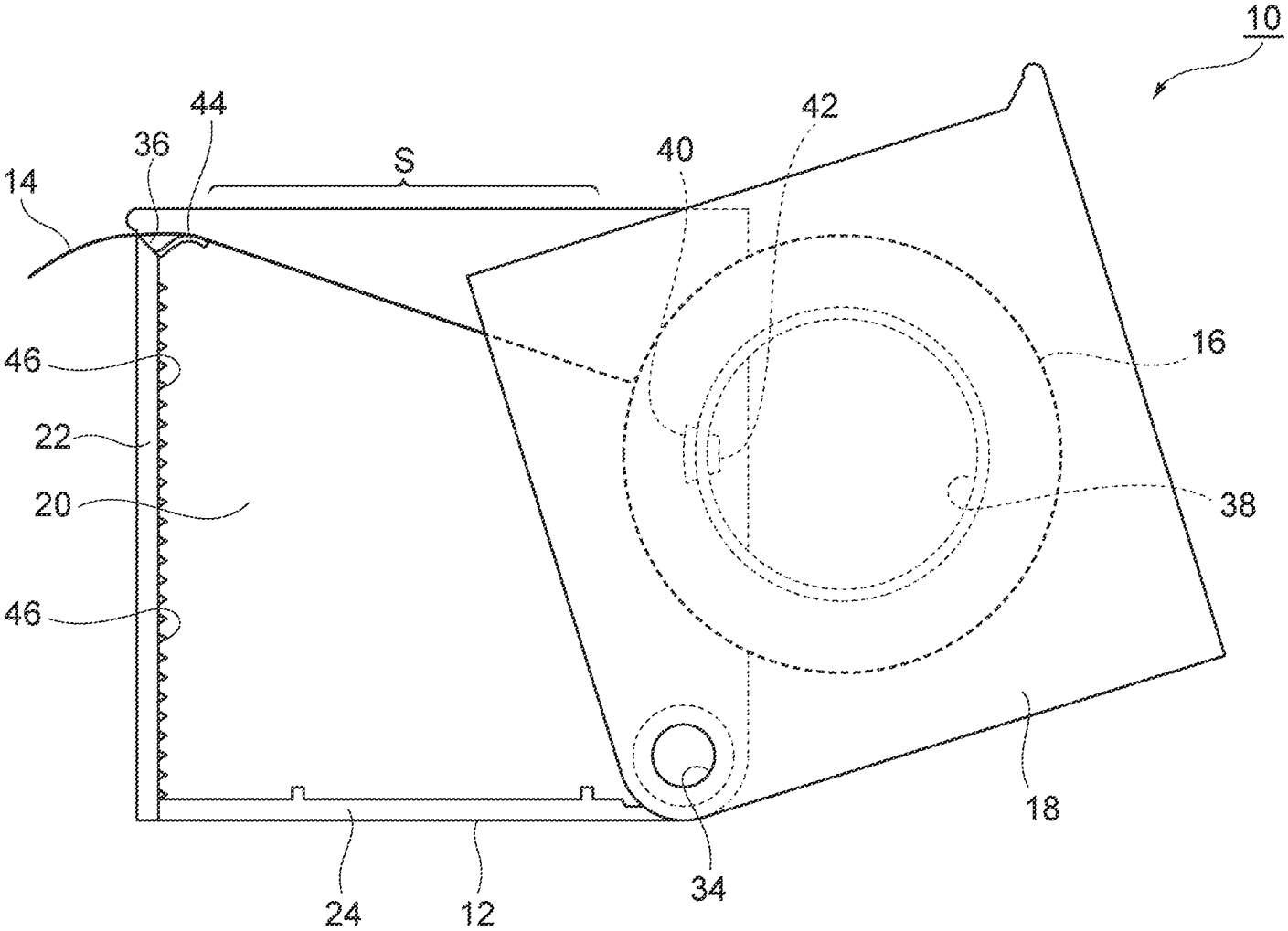
FIG. 3 is a front view showing a use state of the tape dispenser in FIG. 1.
Figure 4:
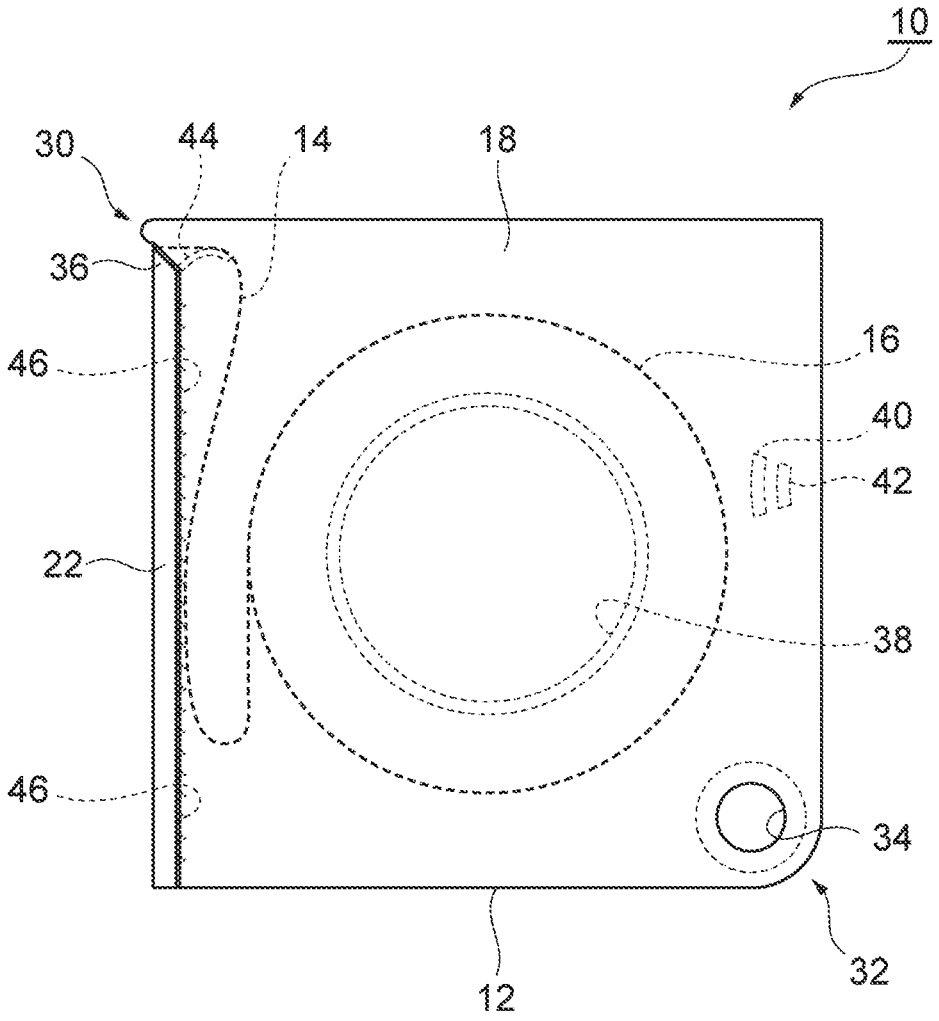
FIG. 4 is a front view showing the tape dispenser in FIG. 1 when not in use.

FIGS. 1 and 2 are three-dimensional diagrams of a first implementation of a tape dispenser 10 including a case 12 according to the present disclosure. FIG. 1 shows the case 12 in a closed state and FIG. 2 shows the case 12 in an opened state. FIGS. 3 and 4 depict the tape dispenser 10 in a use state where the tape roll 16, including an adhesive tape 14 wound in a roll shape around a core, has been installed in the tape dispenser 10.

The tape dispenser 10 includes the case 12 to house the tape roll 16. There are no particular limitations regarding the material of the case 12, however, resin materials are particularly suitable, in that the resulting case can be light weight, easier to handle, and easier to manufacture. The case 12 includes mutually parallel first main plate 18 and second main plate 20 placed at a certain (typically constant) gap. The first main plate 18 and the second main plate 20 are essentially the same size and shape, and as depicted in FIGS. 1 to 14 they are generally square shaped. The shape of the horizontal surface of the main plates is not limited to a square shape. For example, rectangular shape, triangular shapes, pentagram shapes, hexagram shapes, and other multigram type shapes are likewise suitable. Circular shapes, oval shapes, U letter shapes, or shapes formed by the partial extension of these shapes, etc are also contemplated.

In the closed state depicted in FIG. 1 and FIG. 4, the first main plate 18 and the second main plate 20 are facing each other. The case 12 includes side plates 22, 24, 26 and 28 that cooperate to form a circumferential wall between the main plates 18 and 20. When the case 12 is closed, the first main plate 18, the second main plate 20 and the side plates 22-28 cooperate to define an interior space that houses the tape roll 16.

As depicted, two side plates 26, 28 are formed as one body with the first main plate 18 and define a first circumferential wall section. The other two side plates 22, 24 are formed as one body with the second main plate 20 and define a second circumferential wall section. Consequently, it is understood that the circumferential wall of the case 12, which wall is formed from the four side plates 22, 24, 26 and 28 is divided into two circumferential wall sections.

The first and second main plates 18, 20 are mutually connected through a rotation axis 34, so that the main plates (and circumferential wall sections) are rotatable relative to one another. Consequently, the case 12 of the tape dispenser 10 can be opened as shown in FIG. 2 and FIG. 3.

A cutter blade 36, which is used to cut the adhesive tape 14, is provided on the edge part of the side plate 22. In certain circumstances, the edge part of the side plate 28, including shroud 30, can extend over the cutter blade 36 when the case 12 is closed, so that the blade is not exposed. The cutter blade 36 can be formed from a material that is different than that of the second main plate 22; for example, it can be formed from a metal or another type resin material. It can be preferred in certain circumstances that the cutter blade 36 be formed as one body with the side plate 22. By forming the cutter blade 36 and the side plate 22 as one body, it is possible to decrease the process and material costs.

On the inner surface of the first main plate 18 the cylindrically shaped supporting rod 38, which is used for supporting the free rotation of the tape roll 16, is formed as one body. The free end of the supporting rod 38 extends to a position where it engages the inner surface of the second main plate 20.

Figure 5:
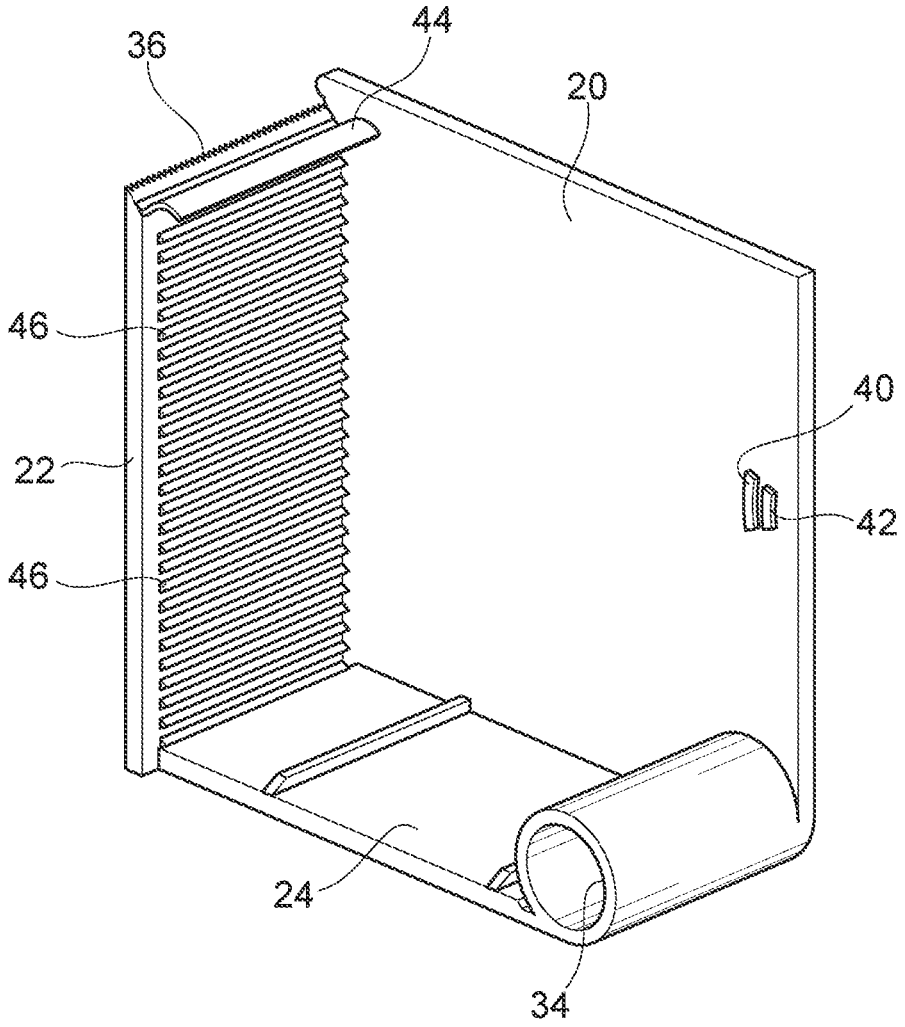
FIG. 5 is a three-dimensional diagram showing the inner surface of the main plate 2 in the tape dispenser in FIG. 1.

FIG. 5 is a three-dimensional diagram showing the inner surface of the second main plate 20 and of the side plates 22, 24. Two protrusions 40, 42 extend outwardly from the inner surface of the second main plate 20. As it is shown in FIG. 3, when the case 12 is opened, the free end of the supporting rod 38 can engage the space between these protrusions 40, 42 and thereby secure the case 12 is an open position. The height of these protrusions 40, 42 is relatively low and by applying a predetermined force, the free end of the supporting rod 38 can surmount the protrusions 40, 42 and the first main plate 18 and the second main plate 20 can rotate further (see, e.g., FIG. 7*a*).

Moreover, the protrusions 40, 42 can function as stoppers to prevent the tape roll 16 from falling off of support axis 38 as the first main plate 18 is moved significantly from the second main plate 20. In certain implementations, only one protrusion may be used to prevent the tape roll from falling off of the support axis 38 during movement.

Figure 6:
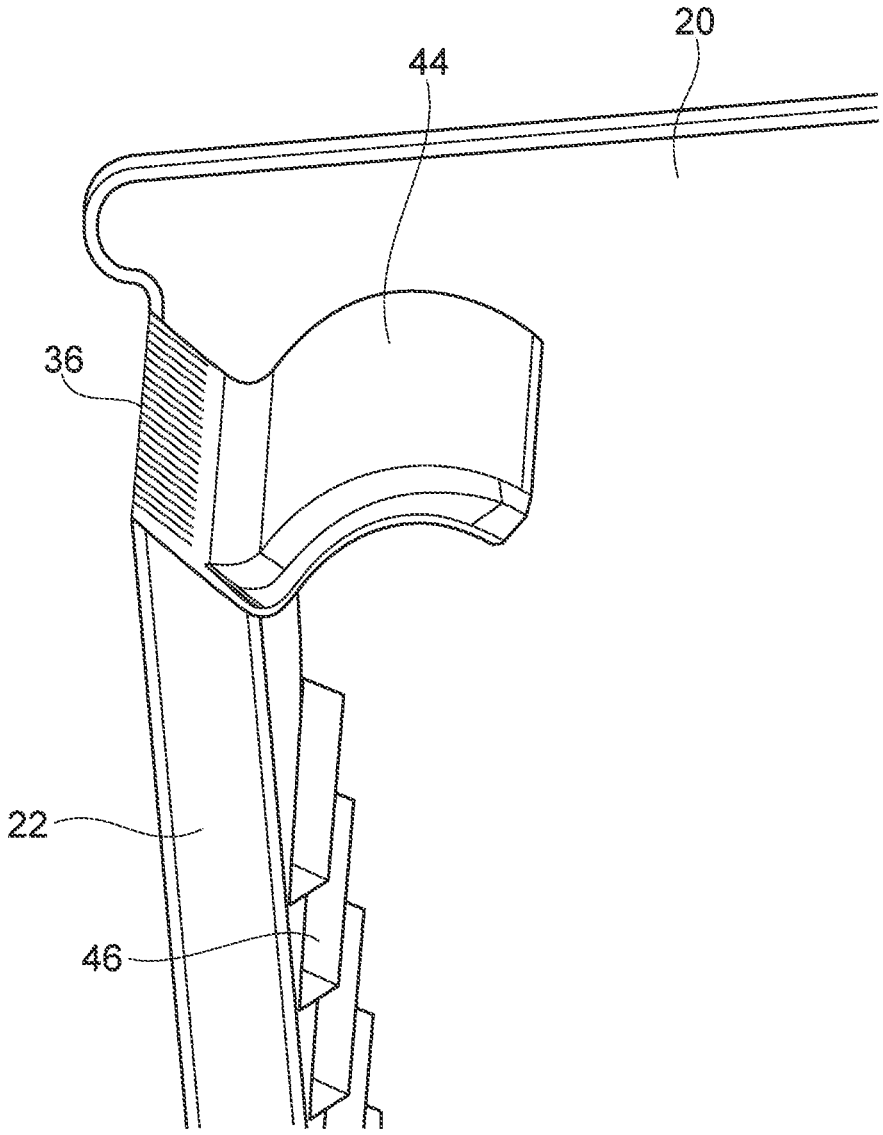
FIG. 6 is an enlarged three-dimensional diagram showing the tape support surface provided on the back surface side of the cutter blade.

Also, as it is understood from FIGS. 5 and 6, it is desirable that a tape supporting surface 44 be formed proximate the back surface side of the cutter blade 36. The tape supporting surface 44 becomes an intersection point at the time of the cutting of the adhesive tape 14, providing support to a user's attempt to cut the tape. Securing a portion of dispensed adhesive tape to the supporting surface 44 can also help to prevent back winding of that adhesive tape 14 on the tape roll 16.

Figure 7A:
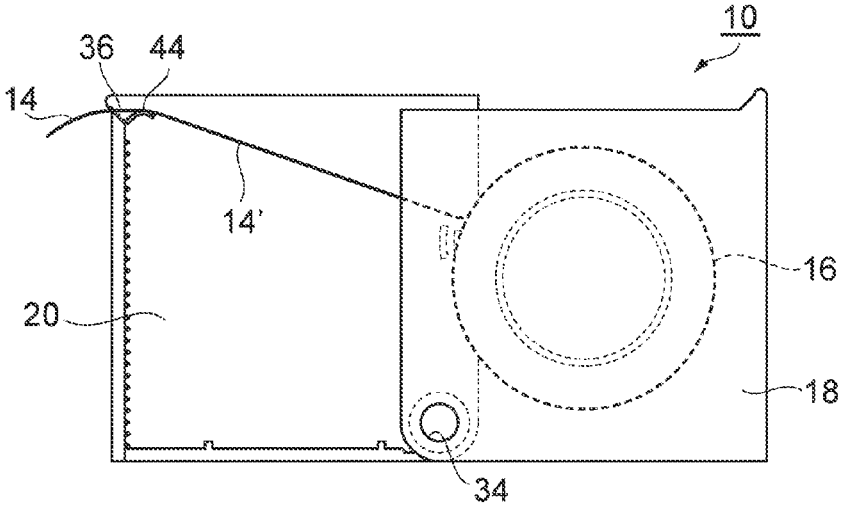
FIG. 7 (*a*)-(*c*) is a diagram showing the change to closed state of the tape dispenser in FIG. 1.
Figure 7B:
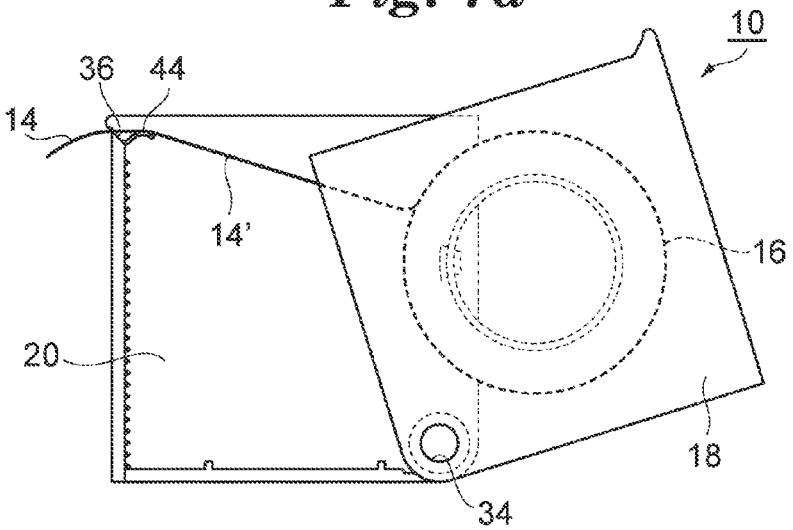
Figure 7C:
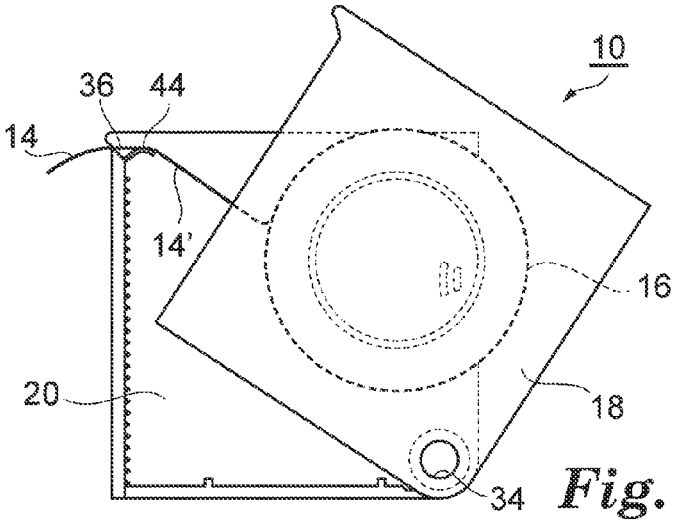

In certain implementations it is desirable for the supporting surface 44 to include a cross section along the surface parallel to the first and second main plates 18, 20 that is arc shaped or at least substantially arc shaped. In the case of prior tape dispensers, the relationship between the extension direction of the tape that can be extended from the tape roll and the position of the cutter blade is almost always constant. Given that relationship, a supporting surface having an almost parallel flat plate surface is typically used. However, as it is shown in FIG. 7, the first main plate 18 can rotate relative to the second main plate 20 using the rotational axis 34 as its center. Because of that, the center position of the tape roll 16 changes with the rotation of the first main plate 18. Consequently, the position of the tape roll at the time when the user cuts the adhesive tape 14 is not necessarily constant, and the tape extension direction at the time when the user cuts the adhesive tape 14 (in FIG. 7, the extension direction of the adhesive tape indicated as 14'), varies depending on the rotational position. A length of adhesive tape also typically extends in a direction on a line continuing from center axis of the tape roll, however, because the tape roll 16 is supported by the supporting rod 38 so that it can freely rotate, the position of the separation start point of the adhesive tape 14 from the tape roll 16 (according to FIG. 7, the intersection point between the adhesive tape 14' and the tape roll 16) varies. For example, as it is understood from FIGS. 7 (*a*), (*b*) and (*c*), in correspondence with the rotational angle between the first main plate 18 and the second main plate 20 and the relative position of the cutter blade 36, the tilt angle of the direction where the tape can be extended becomes different. If a flat tape supporting surface is used, depending on the rotational angle (especially when the rotational angle is shallow) at the time of the cutting of the tape, the tape and the tape supporting surface may not produce sufficient contact surface area and cutting the tape becomes difficult. In addition, there is an increased risk that the tape cannot be protected by the tape supporting surface after cutting.

Contrary to the typical support surface, the tape supporting surface 44 in the depicted embodiment is made to be at least a substantially arc shaped surface and accordingly at least a portion of the extended adhesive tape 14 comes in contact with the tape supporting surface 44 at any rotational angle at which the extended adhesive tape 14 is cut by the cutter blade 36. It is therefore possible for the adhesive tape 14 to regularly achieve sufficient contact surface area relative to the tape support surface 44, and as a result, it is possible to achieve stable and repeated cutting irrespective of the rotational angle and protect the adhesive tape 14 by the tape supporting surface 44 after cutting. Exemplary curvatures for the tape supporting surface 44, for example, include a curvature diameter in the range of 5 mm-20 mm, more preferably, in the range of 8 mm-12 mm, and the length of the arc is in the range of 2 mm-10 mm, and more desirably in the range of 3 mm-5 mm. In certain circumstances it is preferred that the height of the support surface 44 apex be the same as the height of the cutter blade 36 or at most a slightly greater height.

One or more protrusions 46 can be provided on the inner surface of the side plate 22 below the cutter blade 36. At the time when the tape roll is housed (as in FIG. 4), it is possible that portion of adhesive tape 14 can adhere on the inner surface of the case 12, however, such adhesion can be suppressed or reduced through the protrusion 46. It may be preferred in certain implementations that the protrusions 46 repeat along the entire the inner surface of the side plate 22. In other embodiments, the protrusions may repeat over only a portion of the inner surface.

In another aspect, the present disclosure also provides a method of use and application of a tape dispenser 10 with the above described structure.

First, the tape roll 16 is installed on the supporting rod 38, and the front end of the adhesive tape 14 is adhered onto the tape supporting surface 44. The tape roll may be installed by the supplier of the case 12 or the user. Then, the case 12 is opened from the state shown in FIG. 1, through the state shown in FIG. 2 and finishing with the state shown in FIG. 3. Regarding this opening operation, the free end of the supporting rod 38 comes in contact with and engages the inner surface of the second main plate 20, and accordingly becomes mutually supported by the first main plate 18 and the second main plate 20, thereby allowing for stable, one handed operation.

According to the state shown in FIG. 3, the adhesive tape 14 bridges the space between the tape supporting surface 44 and the tape roll 16. As the first main plate has been rotated to this open state, the space is at least partially or substantially exposed, as shown by the symbol S in FIG. 3, and it is thus possible to easily pull out the adhesive tape 14 with a finger.

The free end of the supporting rod 38 can be enclosed in the space between the two protrusions 40 and 42, obviating the need to hold the dispenser tightly to prevent further rotation. The tape dispenser 10 may be opened (i.e., rotated) beyond the state shown in FIG. 3 if desired. The first main plate 18 can rotate to 90 degree angle relative to the second main plate 20 (e.g., FIG. 7 (*a*)), which results in the side plate 24 and the side plate 26 being arranged in a linear fashion to provide a continuous, planar surface. It is thereafter possible to place on the arranged side plates on a flat surface (e.g., table, desk, etc.). Consequently, the tape dispenser 10 can also be used the same way as prior table top type tape dispensers.

To dispense a length of tape, the adhesive tape 14 is separated from the tape supporting surface 44 and it is unwound from the tape roll 16. The user pulls a determined length of adhesive tape beyond the cutter blade 36. The adhesive tape 14 again adheres on the tape supporting surface 44 and accordingly it is possible to cut the adhesive tape 14 using a light and/or reduced force. As discussed above, it is possible to stably support the adhesive tape 14 irrespective of the tilt angle of the extension direction of the adhesive tape 14, due to the at least substantially arc shape of the tape supporting surface 44. Also, irrespective of the rotational angle of the first main plate 18 relative to the second main plate 20, it remains possible to cut the adhesive tape 14 stably and repeatedly, as well as support the adhesive tape 14 through the tape support surface 44 after cutting.

As more tape is cut from the roll, the diameter of the tape roll becomes smaller, and the exit location of the adhesive tape 14 is changed, however, it remains possible to stably support the adhesive tape 14 irrespective of the tilt angle of the adhesive tape 14 due to the shape of the tape support surface 44.

When the user is finished dispensing adhesive tape, the case 12 is returned to the closed state shown in FIG. 1 and FIG. 4. In that state, the tape roll 16 is housed entirely in the case 12. This enclosed housing configuration thus reduces dust adhesion to the tape roll 16 and helps to prevent other unwanted damage during, e.g., transport of the dispenser 10.

When the case 12 is returned to its closed state, the unwound adhesive tape 14 between the tape roll 16 and the support surface 44 enters a relaxed state as shown in FIG. 4. In this state the adhesive surface of the tape 14 can adhere to the inner surface of the side plate 22. For example, if the inner surface of the side plate 22 is flat, substantial portions of adhesive tape 14 can adhere to the side plate 22, and the adhesive between the two becomes relatively large. At the time of the subsequent use, there is a substantial risk that it will be necessary to manually remove the adhesive tape 14 from the side plate 22, which may deform or otherwise affect the subsequent performance of the tape. To counter this effect, a plurality of protrusions 46 can be provided on the inner surface of the side plate 22. The protrusions 46 reduce the contact surface area with the adhesive surface of the tape 14 and the adhesive force of the adhesive tape 14 is reduced or minimized Due to less adhesive force between the adhesive surface and the protrusions 46, the adhesive tape 14 can be easily separated from the side plate 22 before subsequent use.

Additional means of controlling the adhesive force of the adhesive tape 14 relative to the side plate 22, include, but are not limited to, providing numerous small protrusions, subjecting the inner surface of the side plate 22 to sand blasting or embossing processing, or coating by using a silicone type release agent. Also, the position of the application of adhesive force control means is not limited to the inner surface of the side plate 22, and as long as it can contact the adhesive agent surface of the adhesive tape 14 it is a suitable option.

The tape roll 16 can be easily exchanged by rotating the first main plate 18 relative to the second main plate 20 and exposing the supporting rod 38 and the tape roll core. It is also possible, once a new core is installed on the supporting rod 38, to easily grasp and pull out the edge of the adhesive tape 14. The rotation of first main plate 18 relative to second main plate 20 further allows the user to recover back wound tape that has not remained adhered to the support surface 44.

Figure 8:
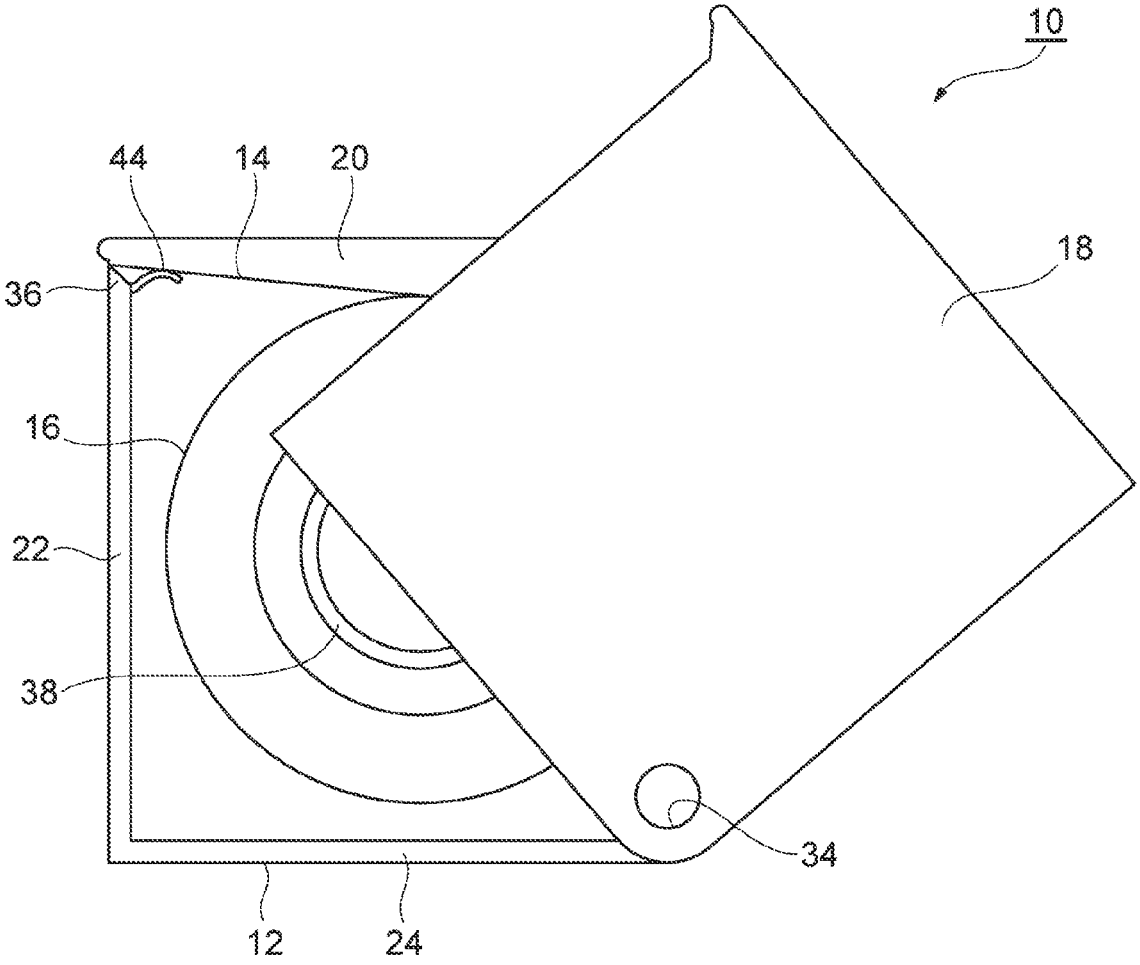
FIG. 8 is a front view diagram showing a modified shape example of the tape dispenser according to the present invention.

The present invention is by no means limited to the above described embodiments. For example, according to the above described embodiment, the first main plate 18 and the supporting rod 38 are formed as one body; however, as shown in FIG. 8, it is also possible to provide the supporting rod 38 in the second main plate 20. In that case, without changing the distance between the supporting rod 38 and the cutter blade 36, the adhesive tape 14 that hangs from the tape roll 16 to the cutter blade 36 becomes short. However, in the case of the opened state of the case 12, the circumferential surface of the tape roll 16 and the adhesive tape 14 are widely exposed, and accordingly the access to the tape is easy, and there are no unfavorable conditions relative to the access such as those according to the previous technology.

Embodiments

1. A tape dispenser comprising a case operable to house a tape roll, the case including: a first main plate, a second main plate spaced from the first main plate and rotatably connected to the first main plate, a circumferential wall between the first main plate and the second main plate, wherein the circumferential wall is divided along its circumferential direction into a first circumferential wall portion and second circumferential wall portion, wherein the first circumferential wall portion is integral with the first main plate, and the circumferential wall portion is integral with the second main plate, a supporting rod extending from one of the first or second main plate in the direction of the opposing main plate, and a cutting blade disposed on one of the first and second circumferential wall portions.

2. The tape dispenser according to the embodiment 1, and further comprising a substantially arc shaped supporting surface disposed proximate the cutter.

3. The tape dispenser according to embodiments 1 or 2, wherein the supporting rod is provided on the first main plate and the cutter is provided on the second circumferential wall part.

4. The tape dispenser according to embodiments claims 1-3 wherein an inner surface of the circumferential wall includes one or more protrusions.

5. The tape dispenser according to embodiments 1-3, wherein an inner surface of the circumferential wall comprises a sand-blasted surface, an embossed surface, or a release agent.

6. The tape dispenser according to embodiments 1-5, wherein the supporting rod extends from the first main plate and includes a free end, wherein the free end contacts and engages the surface of the second main plate, and wherein the second main plate includes a protrusion connectable with the free end to limit the movement of the supporting rod.

7. The tape dispenser according to embodiments 1-6, and further comprising a tape roll disposed on the supporting rod, wherein the first main plate and corresponding circumferential wall portions are rotatable relative to the second main plate to expose at least a portion of the tape roll.

8. A tape dispenser that is characterized by the fact that it is a dispenser where a case, which houses a tape roll whose structure is formed as an adhesive tape is wound in a roll shape, is provided, and the adhesive tape that is unwound from the tape roll can be cut by this dispenser, the case is characterized by the fact that it is equipped with the main plate 1, the main plate 2, which is placed at a certain gap from this main plate 1, a circumferential wall provided in the space between the main plate 1 and the main plate 2, and a supporting rod, which is used in order to support the tape roll so it can freely rotate and which is provided on either of the main plate 1 or the main plate 2 and extends facing the other main plate, and regarding the circumferential wall, which mutually connects the main plate 1 and the main plate 2, so they can move, it is divided along its circumferential direction into a circumferential wall part 1 and circumferential wall part 2, and the circumferential wall part 1 is formed as one body with the main plate 1, and the circumferential wall part 2 is formed as one body with the main plate 2, and on either one of the circumferential part 1 or the circumferential part 2 a cutter blade is provided.

9. A tape dispenser according to embodiment 8, characterized by the fact that an almost arc shaped tape supporting surface is provided on the back surface side of the above described cutter.

10. A tape dispenser according to embodiments 8 and 9 characterized by the fact that the above described supporting rod is provided on the above described main plate and the above described cutter blade is provided on the above described second circumferential wall part.

11. A tape dispenser according to embodiments 8-10, characterized by the fact that on the inner surface of the above described circumferential wall a means for controlling the adhesive force of the above described adhesive tape, is provided.

12. Tape dispenser according to embodiments 8-11 characterized by the fact that the free end of the above described supporting rod that is provided on either of the above described first main plate or second main plate, contacts the other main plate, and it can rub its surface, and on the above described other main plate, a protrusion is provided, which is connected with the above described free axis of the supporting rod and limits the movement of the above supporting rod.

The complete disclosures of the patents, patent documents, and publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A tape dispenser comprising a case operable to house a tape roll, the case including:

a first main plate, a second main plate spaced from the first main plate and rotatably connected to the first main plate via a single rotation axis about which the first main plate and second main plate move in parallel orientation to one another, the second main plate having a surface, a circumferential wall between the first main plate and the second main plate, wherein the circumferential wall is divided along its circumferential direction into a first circumferential wall portion and second circumferential wall portion, wherein the first circumferential wall portion is integral with the first main plate, and the second circumferential wall portion is integral with the second main plate, a supporting rod extending from the first main plate in the direction of the second main plate, wherein the supporting rod is adapted to support a freely rotating tape roll between the first main plate and the second main plate and the location of the supporting rod on the first main plate is offset from where the first main plate is rotatably connected to the second main plate, the supporting rod extending from the first main plate and including a free end, wherein the free end contacts and engages the surface of the second main plate, and wherein the second main plate includes a protrusion connectable with the free end to limit the movement of the first main plate relative to the second main plate, a cutting blade disposed on the second circumferential wall portion, and a substantially arc shaped supporting surface disposed on the second circumferential wall portion proximate the cutting blade, wherein the inner surface of the second circumferential wall portion comprises one or more protrusions, a sand blasted surface, an embossed surface, or a release agent.

2. The tape dispenser according to claim 1, and further comprising a tape roll disposed on the supporting rod, wherein the first main plate and corresponding circumferential wall portions are rotatable relative to the second main plate to expose at least a portion of the tape roll.

* * * * *